US007062993B2

(12) United States Patent
Shaw et al.

(10) Patent No.: US 7,062,993 B2
(45) Date of Patent: Jun. 20, 2006

(54) TORQUE WRENCH

(76) Inventors: Raymond Shaw, P.O. Box 10098, Rockville, MD (US) 20849-0098; Hongbing Ou, Room 1901, No. 10, Lane 609 Caoyang Road, Shanghai (CN) 200063

( * ) Notice: Subject to any disclaimer, the term of this patent is extended or adjusted under 35 U.S.C. 154(b) by 0 days.

(21) Appl. No.: 11/226,486

(22) Filed: Sep. 14, 2005

(65) Prior Publication Data

US 2006/0053981 A1 Mar. 16, 2006

(51) Int. Cl.
*B24B 13/46* (2006.01)

(52) U.S. Cl. ..... 81/57.39; 81/57.44; 81/54

(58) Field of Classification Search ..... 81/54, 81/57.39, 57.44
See application file for complete search history.

(56) References Cited

U.S. PATENT DOCUMENTS

| | | | |
|---|---|---|---|
| 4,201,099 | A | 5/1980 | Junkers |
| 4,385,533 | A | 5/1983 | Collins |
| 4,429,597 | A | 2/1984 | Grabovac |
| 4,448,096 | A | 5/1984 | Collins |
| 4,663,997 | A | 5/1987 | Junkers |
| 4,669,338 | A | 6/1987 | Collins |
| 4,744,271 | A | 5/1988 | Collins |
| 4,753,139 | A | 6/1988 | Junkers |
| 4,819,520 | A | 4/1989 | Collins |
| 4,825,730 | A | 5/1989 | Junkers |
| 4,846,028 | A | 7/1989 | Junkers |
| 4,921,010 | A | 5/1990 | Spirer |
| 4,982,626 | A | 1/1991 | More et al. |
| RE33,951 | E | 6/1992 | Junkers |
| 5,140,874 | A | 8/1992 | Junkers |
| 5,311,796 | A | 5/1994 | Junkers |
| 5,325,742 | A | 7/1994 | Miller |
| D363,770 | S | 10/1995 | Junkers |
| 5,924,340 | A | 7/1999 | Junkers |
| D416,474 | S | 11/1999 | Wang |
| D420,279 | S | 2/2000 | Wang |
| D420,280 | S | 2/2000 | Wang |
| D420,894 | S | 2/2000 | Wang |
| 6,089,265 | A | 7/2000 | Wang |
| 6,112,622 | A | 9/2000 | Reiman |
| D465,394 | S | 11/2002 | Junkers |
| D485,159 | S | 1/2004 | Junkers |
| 6,715,381 | B1 | 4/2004 | Junkers |
| D491,435 | S | 6/2004 | Junkers |

(Continued)

FOREIGN PATENT DOCUMENTS

| | | | |
|---|---|---|---|
| DE | 29821479 | U1 | 5/1999 |

(Continued)

*Primary Examiner*—Lee D. Wilson
*Assistant Examiner*—Shantese McDonald
(74) *Attorney, Agent, or Firm*—Quarles & Brady LLP

(57) ABSTRACT

A torque wrench includes a housing having a first opening disposed opposite a second opening. The torque wrench also includes a ratchet wheel disposed in the housing and forming a shaft connecting the first opening and the second opening, a ratchet lever engaging the ratchet wheel to rotate the ratchet wheel in a given direction, and a hydraulically actuated piston disposed in the housing and connected to the ratchet lever to move the ratchet lever between a first position and a second position to rotate the ratchet wheel. The torque wrench further includes a removable drive shaft extending through the shaft to engage the ratchet wheel and be rotated by the ratchet wheel in the given direction and a first seal disposed at the first opening and a second seal disposed at the second opening to create respective seals between the housing and the drive shaft.

20 Claims, 10 Drawing Sheets

U.S. PATENT DOCUMENTS

| | | | | |
|---|---|---|---|---|
| D491,436 | S | 6/2004 | Junkers | |
| 6,802,235 | B1 | 10/2004 | Junkers et al. | |
| D500,060 | S | 12/2004 | Junkers | |
| 6,912,933 | B1 * | 7/2005 | Knopp et al. | 81/57.39 |
| 2002/0121161 | A1 | 9/2002 | Koppenhoefer | |
| 2003/0126956 | A1 | 7/2003 | Junkers et al. | |
| 2003/0131691 | A1 | 7/2003 | Spirer | |
| 2003/0136229 | A1 | 7/2003 | Junkers | |
| 2004/0200320 | A1 | 10/2004 | Knopp | |

FOREIGN PATENT DOCUMENTS

| | | | |
|---|---|---|---|
| DE | 29905480 | U1 | 7/1999 |
| WO | WO 97/00759 | | 1/1997 |

* cited by examiner

FIG. 2
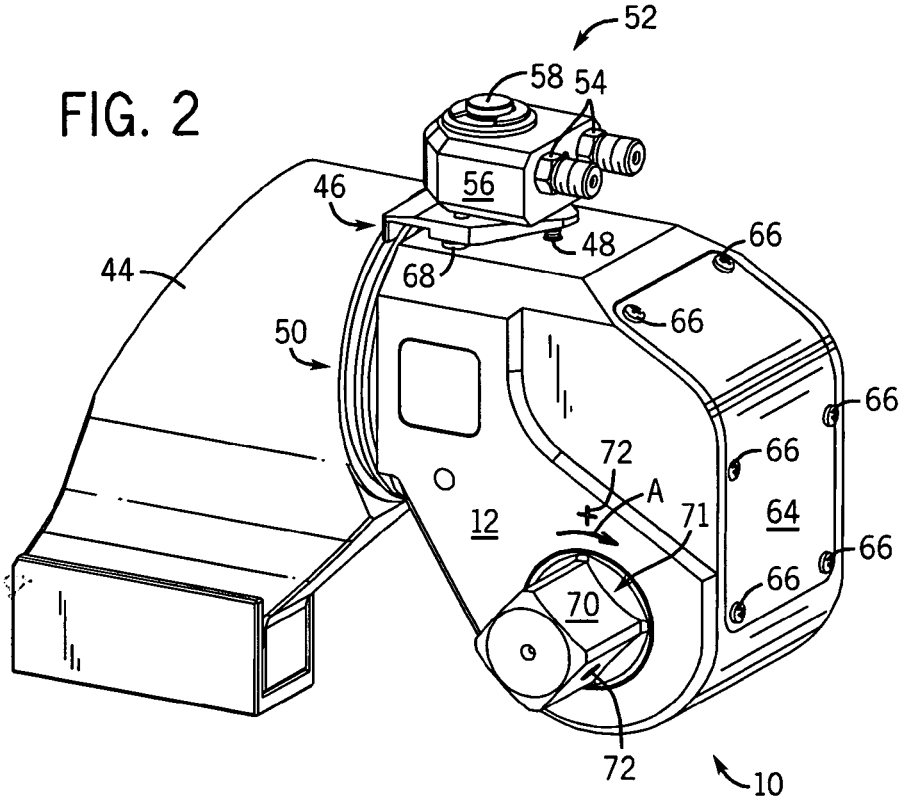
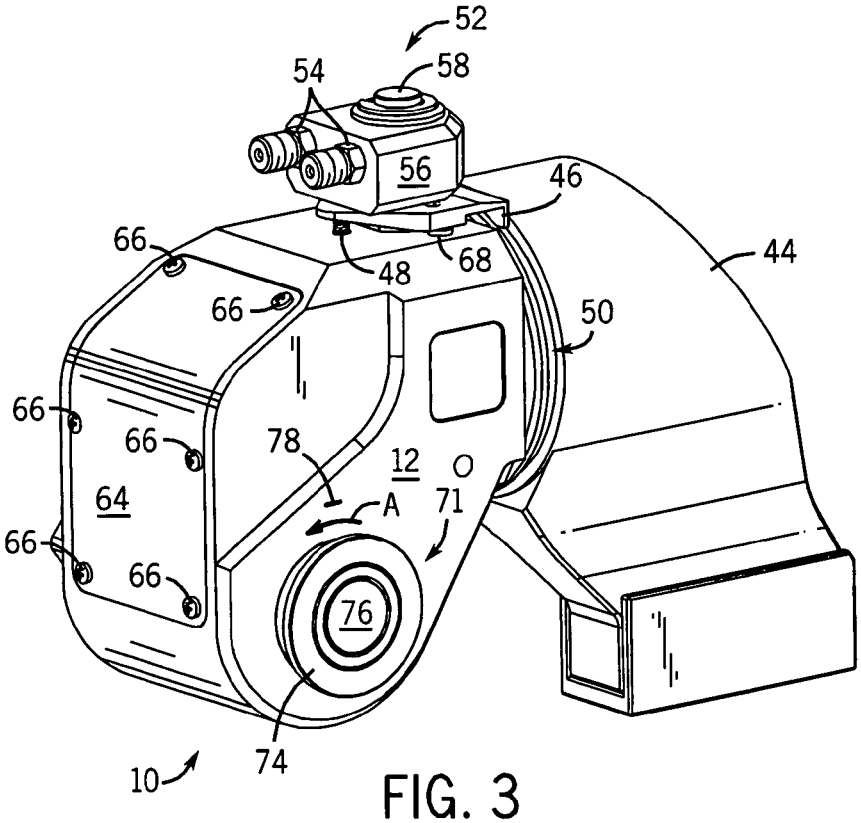
FIG. 3

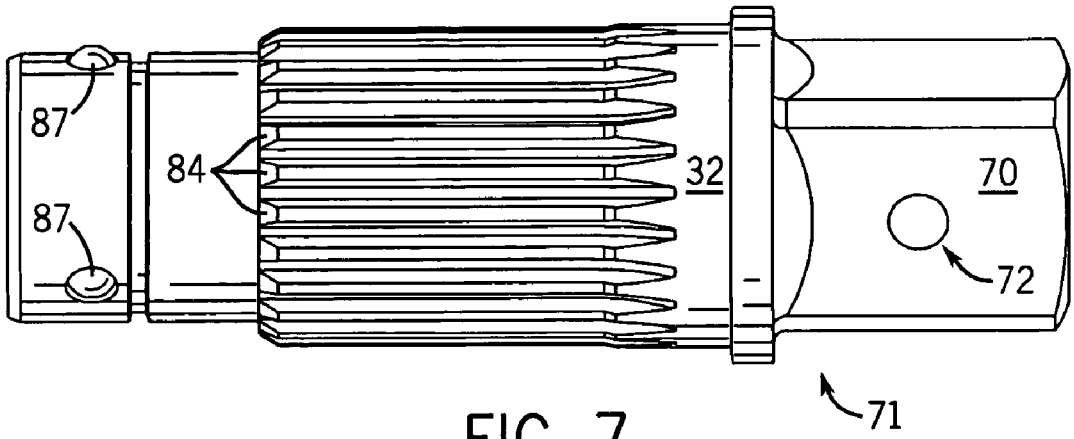
FIG. 7
FIG. 8
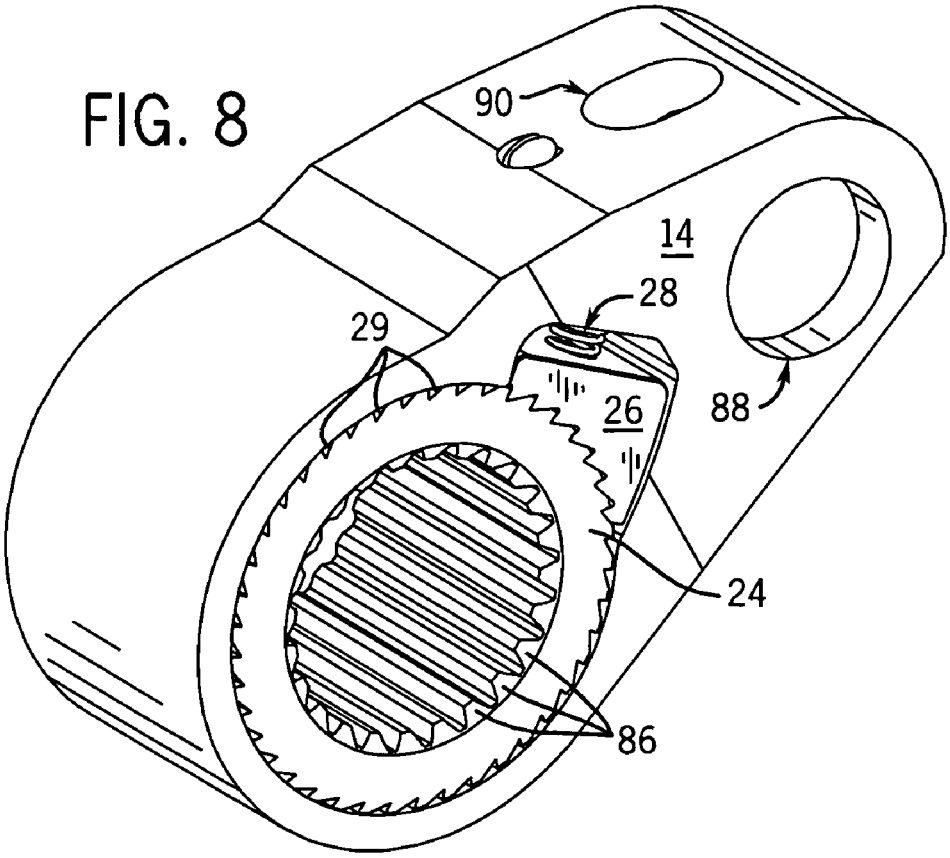

TORQUE WRENCH

CROSS-REFERENCE TO RELATED APPLICATION

This application is based on Chinese Patent Application Nos. 200410066373.5 and 200420090053.9, both filed on Sep. 15, 2004, and entitled "MULTI-FUNCTIONAL SQUARE DRIVE TORQUE WRENCH".

STATEMENT CONCERNING FEDERALLY SPONSORED RESEARCH OR DEVELOPMENT

Not applicable.

FIELD OF THE INVENTION

This invention relates generally to a torque wrench and more particularly to a hydraulic torque wrench having a sealed housing and a removable drive that sealingly engages the torque wrench.

BACKGROUND OF THE INVENTION

Hydraulic torque wrenches are well known and useful in many heavy industries. It is useful for such wrenches to be as small as possible so as to fit into the tight spaces and engage a nut or bolt. Such wrenches also should be designed with a high torque-to-weight ratio and as long of a stroke as possible to make tightening (and loosening) bolts more efficient. In addition, such wrenches should be rugged, serviceable, and able to withstand the elements.

The present invention provides a hydraulic torque wrench of high performance, reliability, and repeatability. The wrench can be used in many different applications to provide a high torque-to-weight ratio and high speed operation. Additionally, the wrench includes a plurality of seals that protects the components of the wrench against the intrusion of dirt, debris, and liquids. Accordingly, the wrench is readily usable in a variety of environments that may be too harsh or abrasive for traditional wrenches.

SUMMARY OF THE INVENTION

The present invention provides a hydraulic wrench. The wrench is sealed so as to be usable in a variety of environments. In particular, the wrench includes a seal about a cover closing an opening into a cavity within a housing of the wrench in which the components of the wrench, such as a ratchet lever and a hydraulically actuated piston, are disposed. Additionally, the wrench includes a removable drive that sealingly engages the torque wrench. Accordingly, the wrench is sealed against the intrusion of dirt, debris, and liquids to allow the wrench to be utilized in a wide variety of environments without diminishing the life of the torque wrench.

In accordance with one aspect of the invention, a torque wrench is disclosed that includes a housing having a first opening disposed opposite a second opening. The torque wrench also includes a ratchet wheel disposed in the housing and forming a shaft connecting the first opening and the second opening, a ratchet lever engaging the ratchet wheel to rotate the ratchet wheel in a given direction, and a hydraulically actuated piston disposed in the housing and connected to the ratchet lever to move the ratchet lever between a first position and a second position to rotate the ratchet wheel. The torque wrench further includes a removable drive shaft extending through the shaft to engage the ratchet wheel and be rotated by the ratchet wheel in the given direction and a first seal disposed at the first opening and a second seal disposed at the second opening to create respective seals between the housing and the drive shaft.

In accordance with another aspect of the invention, a torque wrench is disclosed that includes a ratchet wheel, a ratchet lever engaging the ratchet wheel to rotate the ratchet wheel in a given direction, and a hydraulically actuated piston connected to the ratchet lever to move the ratchet lever between a first position and a second position to rotate the ratchet wheel. The torque wrench also includes a drive shaft extending through the shaft to engage the ratchet wheel and be rotated by the ratchet wheel in the given direction and a housing having an access portal formed therein to allow the ratchet wheel, the ratchet lever, and the hydraulically actuated piston to be disposed within the housing. Additionally, the torque wrench includes a cover configured to removeably engage the housing to cover the access portal and at least one seal disposed between the cover and the housing to seal the access portal.

These and other features and advantages of the invention will be apparent from the detailed description and drawings.

BRIEF DESCRIPTION OF THE DRAWINGS

FIG. 2 is a front, left-side, perspective view of the hydraulic torque wrench of FIG. 1;

FIG. 3 is a front, right-side, perspective view of the hydraulic torque wrench of FIG. 1;

FIG. 7 is a perspective view of a drive for use with the hydraulic torque wrench of FIGS. 1–5;

FIG. 8 is a perspective view of a ratchet lever, ratchet wheel, and pawl assembly shown in FIG. 1;

DETAILED DESCRIPTION OF THE PREFERRED EMBODIMENT

Figure 1:
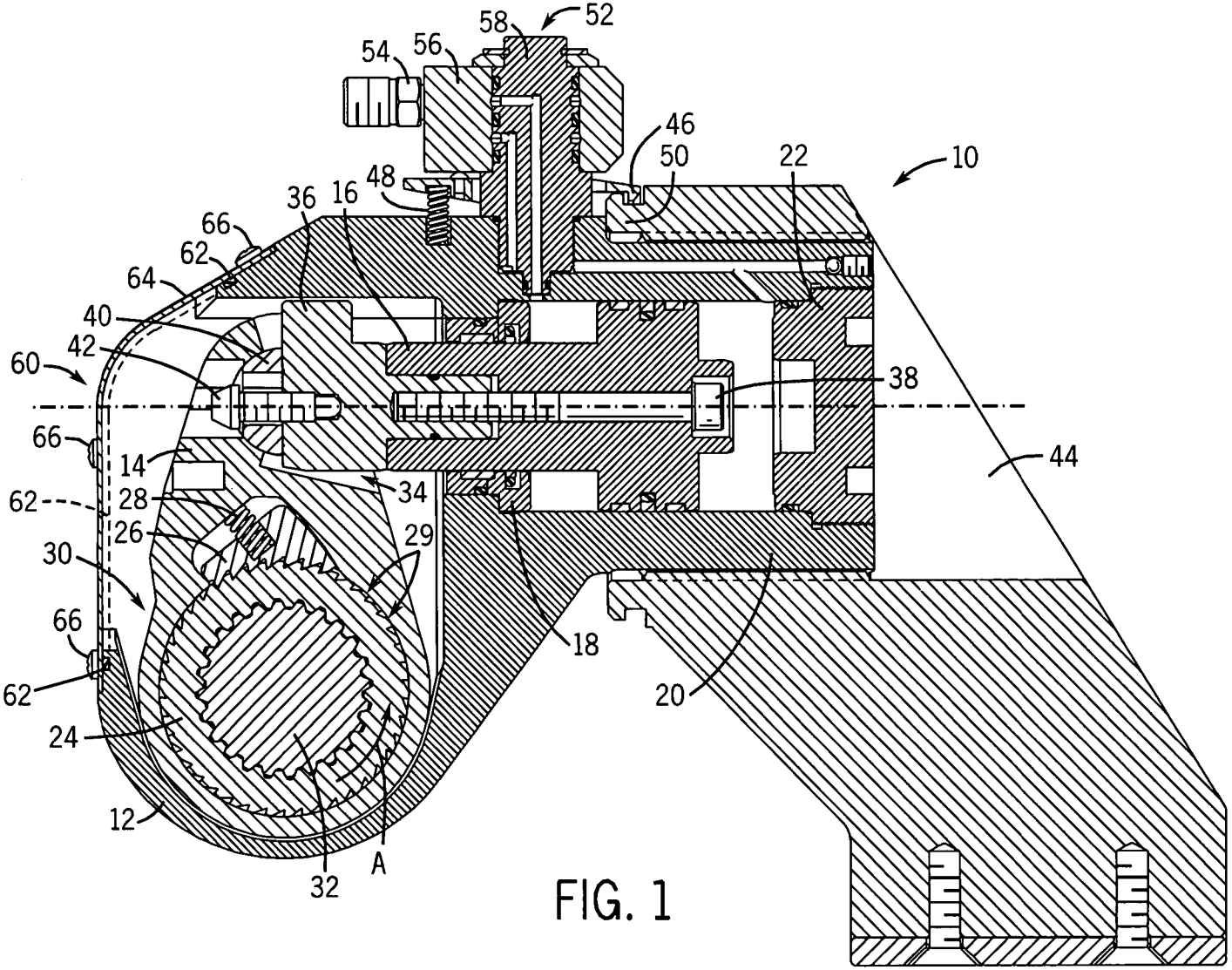
FIG. 1 is a cross-sectional plan view of a hydraulic torque wrench in accordance with the present invention.
Figure 14:
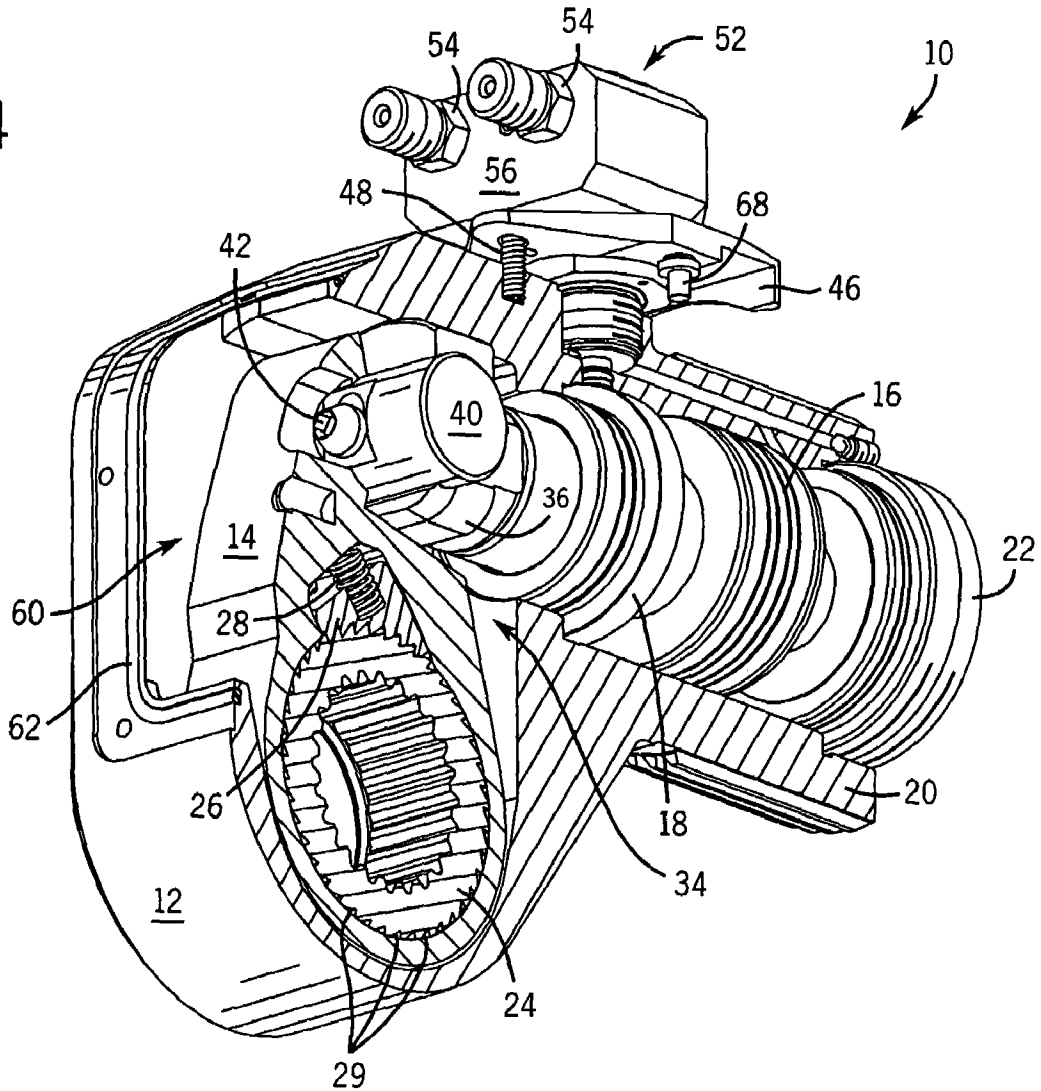
FIG. 14 is a front, right-side, perspective, cut-away view of the hydraulic torque wrench of FIGS. 1–5.
Figure 15:
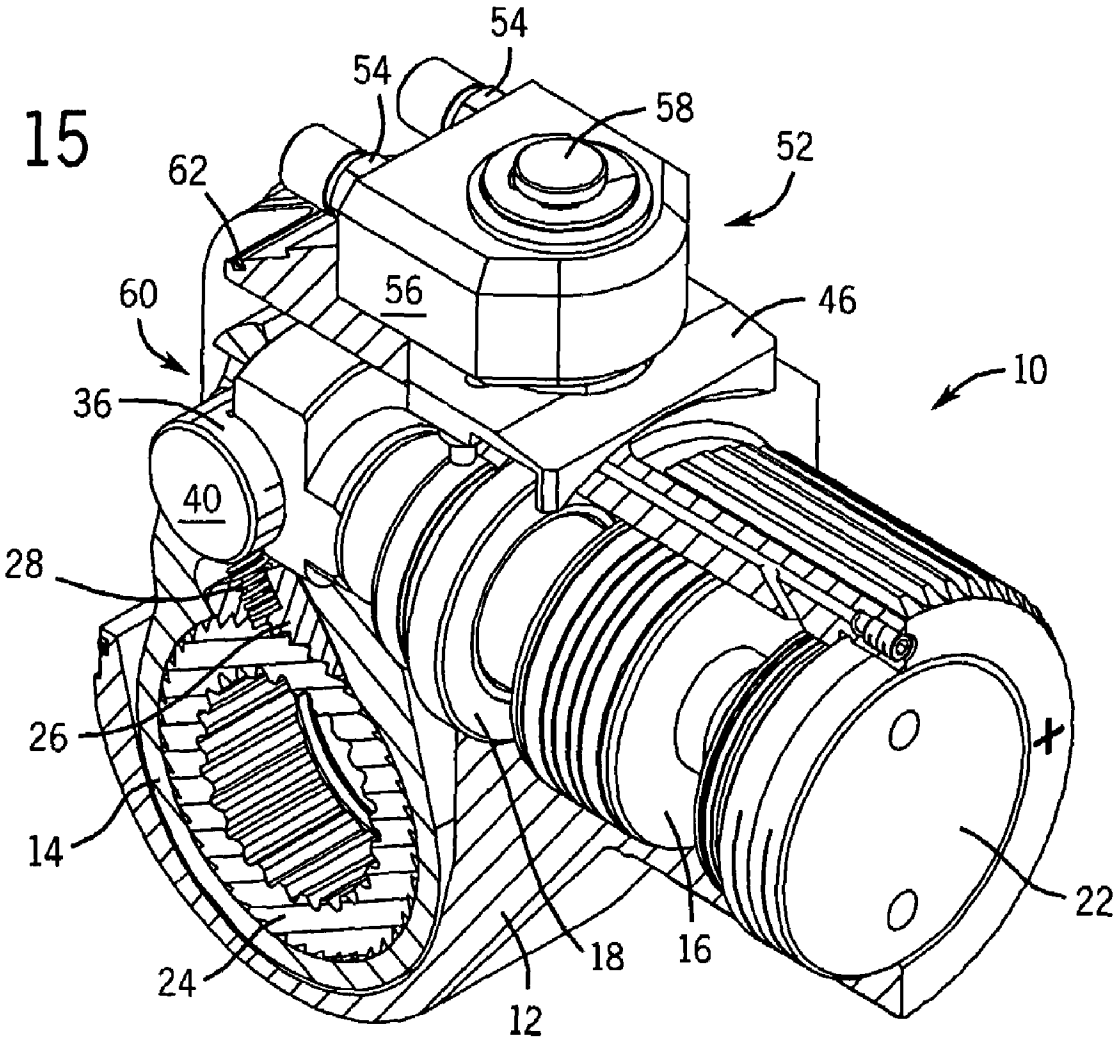
FIG. 15 is a rear, right-side, perspective, cut-away view of the hydraulic torque wrench of FIGS. 1–5.

Referring to FIGS. 1, 14, and 15, a cross sectional/cut-away view of a hydraulic torque wrench 10 is shown. The hydraulic torque wrench 10 includes a housing 12. The housing 12 supports a ratchet lever 14 as well as a piston 16, through a support ring 18. Specifically, the piston 16 is enclosed in the housing 12 in a piston shaft 20 that terminates at a threaded end cover 22.

Disposed within the ratchet lever 14 is a ratchet wheel 24 engaged by a pawl 26 held, by way of a bias spring 28, against a plurality of teeth 29. In this regard, the ratchet lever 14, ratchet wheel 24, pawl 26, and bias spring 28 form a ratchet lever assembly 30, as shown in FIG. 8. Additionally, as will be described, extending through the ratchet wheel 24 is a drive shaft 32. As will be described, the drive associated with the drive shaft 32 may be a square drive, Allen key drive, or other similar drive.

The piston 16 is connected to the ratchet lever 14 through a joint assembly 34. The joint assembly 34 includes a piston end cap 36 connected to the piston 16 through a screw 38 extending therethrough. The joint assembly 34 also includes a hinge pin 40 extending through the ratchet lever 14 and connected to the piston end cap 36 through a screw 42.

Mounted on the housing 12 is a reaction arm 44 that is retained thereon by way of a quick latch 46. The quick latch 46 is biased by a spring 48 to engage a lip 50 formed in the reaction arm 44. The quick latch 46 is integrated with a hydraulic fluid port 52 that supplies hydraulic fluid to the piston shaft 20 to reciprocate the piston 16. The fluid port 52 includes a pair of quick couplers 54 connected through a swivel connection block 56 to a swivel connection bolt 58.

To assemble the hydraulic torque wrench 10, the ring support 18 followed by the piston 16 are inserted into the housing 12 through the piston shaft 20. The piston end cap 36 is then inserted into the housing 12 via an access portal 60 formed in the housing 12 opposite the piston shaft 20. Once the piston end cap 36 is in place, the screw 38 is threaded through the piston 16 to engage the piston end cap 36. Once the screw 38 is tightened, the threaded cover 22 is then screwed into the housing 12 to close and seal the piston shaft 20.

After the piston 16 and piston end cap 36 are assembled, the pre-assembled ratchet lever assembly 30 having the hinge pin 40 in place is then inserted into the housing 12 though the access portal 60. Accordingly, the screw 42 is threaded through the hinge pin 40 to engage the piston end cap 36 and form the joint assembly 34.

Once the ratchet lever assembly 30 and piston 16 have been joined through the joint assembly 34, an o-ring 62 is positioned in a groove within the housing 12 surrounding the access portal 60 and a cover 64 is tightened over the access portal 60 using a plurality of screws 66. The o-ring 62 is preferably formed of rubber or other material suitable to form a seal between the cover 64 and the housing 12. Finally, the hydraulic fluid port 52 is mounted on the housing 12 via a plurality of screws 68.

In operation, hydraulic fluid is supplied via the hydraulic fluid port 52 and passed through the housing 12 into the piston shaft 20 to drive the piston 16 and, thereby, the ratchet lever 14 in a reciprocating motion. In this regard, the ratchet lever 14, through engagement of the pawl 26 with the plurality of teeth 29, rotates the ratchet wheel 24 in a direction indicated by, generally, by arrow, A. Accordingly, the drive shaft 32 is rotated in direction A.

In this regard, as shown in FIG. 2, for example, a socket receptacle 70 that is connected to the drive shaft 32 of FIG. 1, is rotated in direction A. Again, though a square socket receptacle 70 is shown, it is contemplated that various other shaped receptacles may also be used. As will be described, the drive shaft 32 and socket receptacle 70 form portions of a removable and adjustable drive generally designated 71. As shown in FIG. 2, a positive marker 72 indicates that a socket (not shown), which could be attached to the socket receptacle 70 using receptacles 70, would be rotated with the socket receptacle 70 to tighten an associated bolt.

Referring to FIG. 3, the opposite side of the drive 71 is retained by a drive end cap 74. As will be described in detail with respect to FIGS. 9–11, the drive end cap 74 is removable using a push-button 76 disposed at an end of the drive shaft 32 (FIG. 1) opposite the socket receptacle 70 (FIG. 2). Accordingly, the socket receptacle 70 and drive shaft 32 may be removed from the housing 12 and reinserted in an opposite direction such that the socket receptacle 70 extends from the right side of the torque wrench 10 shown in FIG. 3. When configured to have the socket receptacle 70 extend from the right side of the torque wrench 10, the socket receptacle 70 is rotated in direction A, which, as indicated by a negative marker 78, causes an associated bolt to be loosened.

Figure 4:
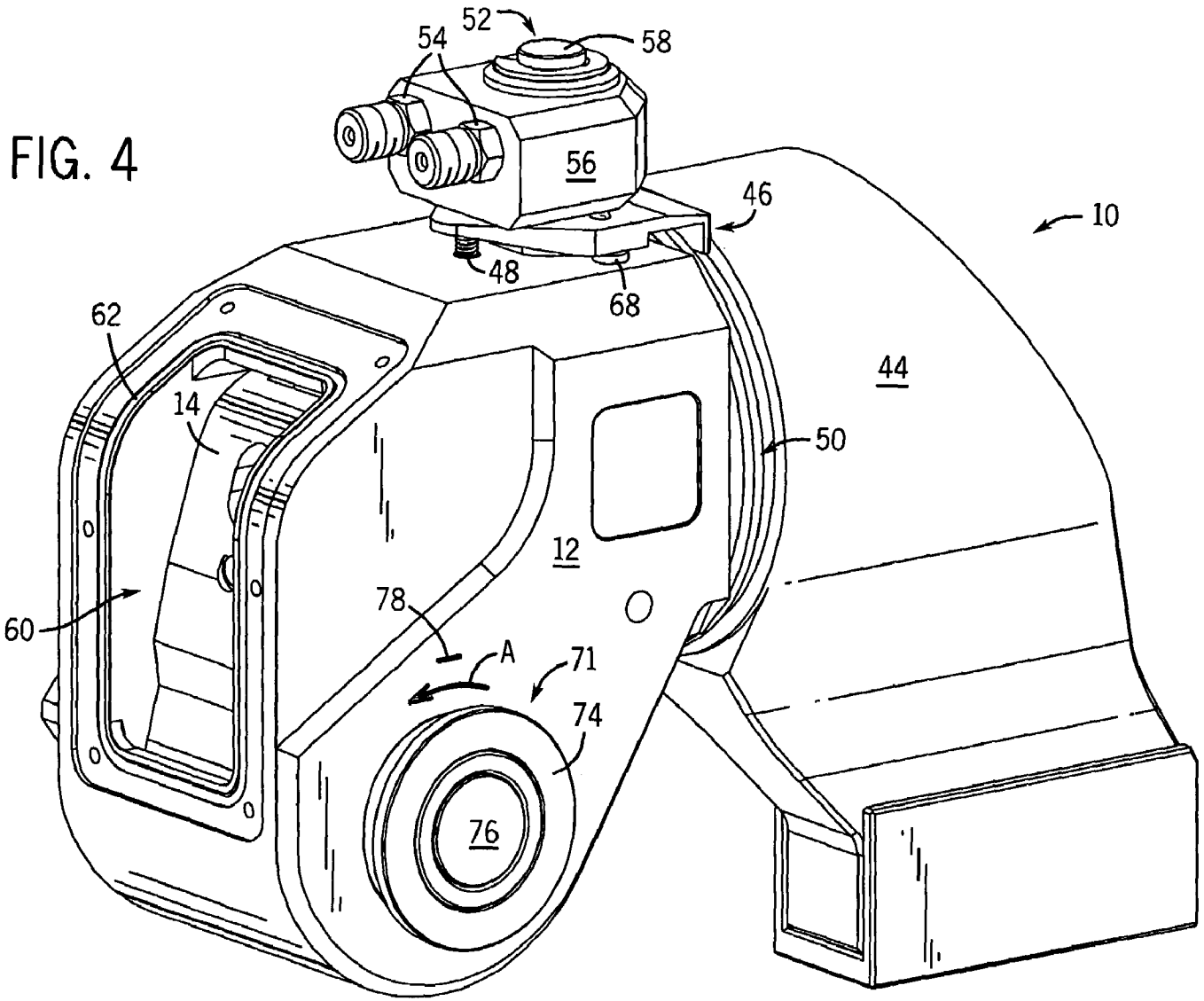
FIG. 4 is a front, right-side, perspective view similar to that shown in FIG. 3 with a front access panel removed.
Figure 5:
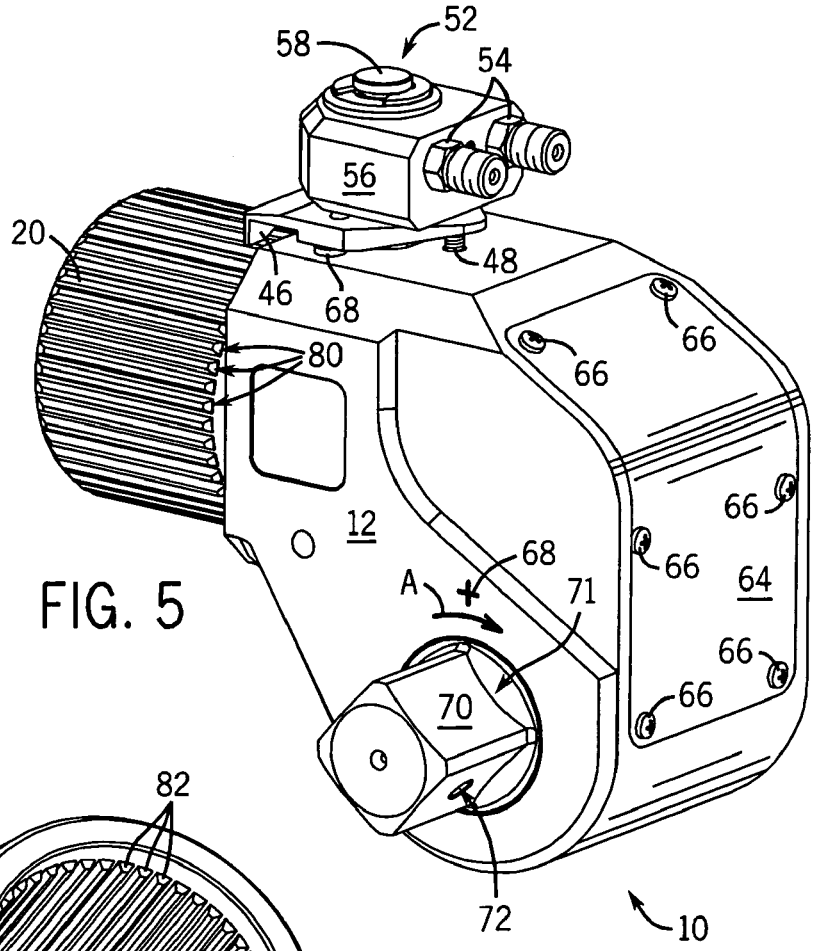
FIG. 5 is a front, left-side, perspective view similar to that shown in FIG. 2 with a reaction arm removed.
Figure 6:
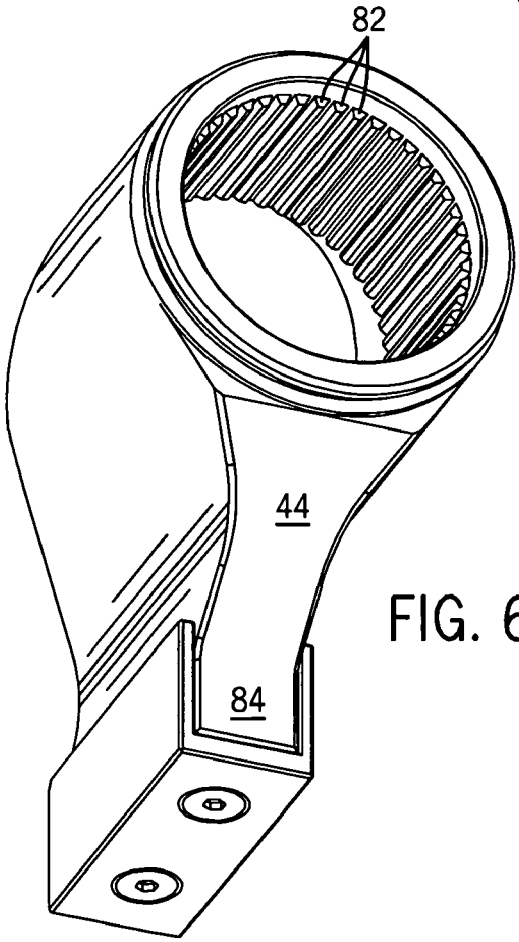
FIG. 6 is a perspective view of a reaction arm for use with the hydraulic torque wrench of FIGS. 1–5.

Referring now to FIG. 4, the torque wrench 10 is shown with the cover 64 of FIGS. 1–3 removed. Accordingly, the o-ring 62 that is configured to seal the access portal 60 is shown. Additionally, referring to FIG. 5, the torque wrench 10 is show with the reaction arm 44 removed to show that a plurality of splines 80 are arranged around the exterior of the piston shaft 20. Similarly, as shown in FIG. 6, the reaction arm 44 includes a matching plurality of splines 82. In this regard, the reaction arm 44 may engage the exterior of the piston shaft 20 at any of a plurality of positions to vary an angle created between a wing 84 of the reaction arm 44 with respect to the side of the housing 12.

Referring to FIGS. 7 and 8, the drive 71 and the ratchet lever assembly 30, respectively, are shown removed from the housing 12 of the torque wrench 10. The drive shaft 32 includes a plurality of splines 82 that are configured to mate with a plurality of splines 86 arranged about an interior wall of the ratchet wheel 24 opposite the teeth 29 arranged about the exterior wall of the ratchet wheel 24. Accordingly, as previously described, when the two components are engaged, the drive shaft 32 is rotated with the ratchet wheel 24.

Figure 9:
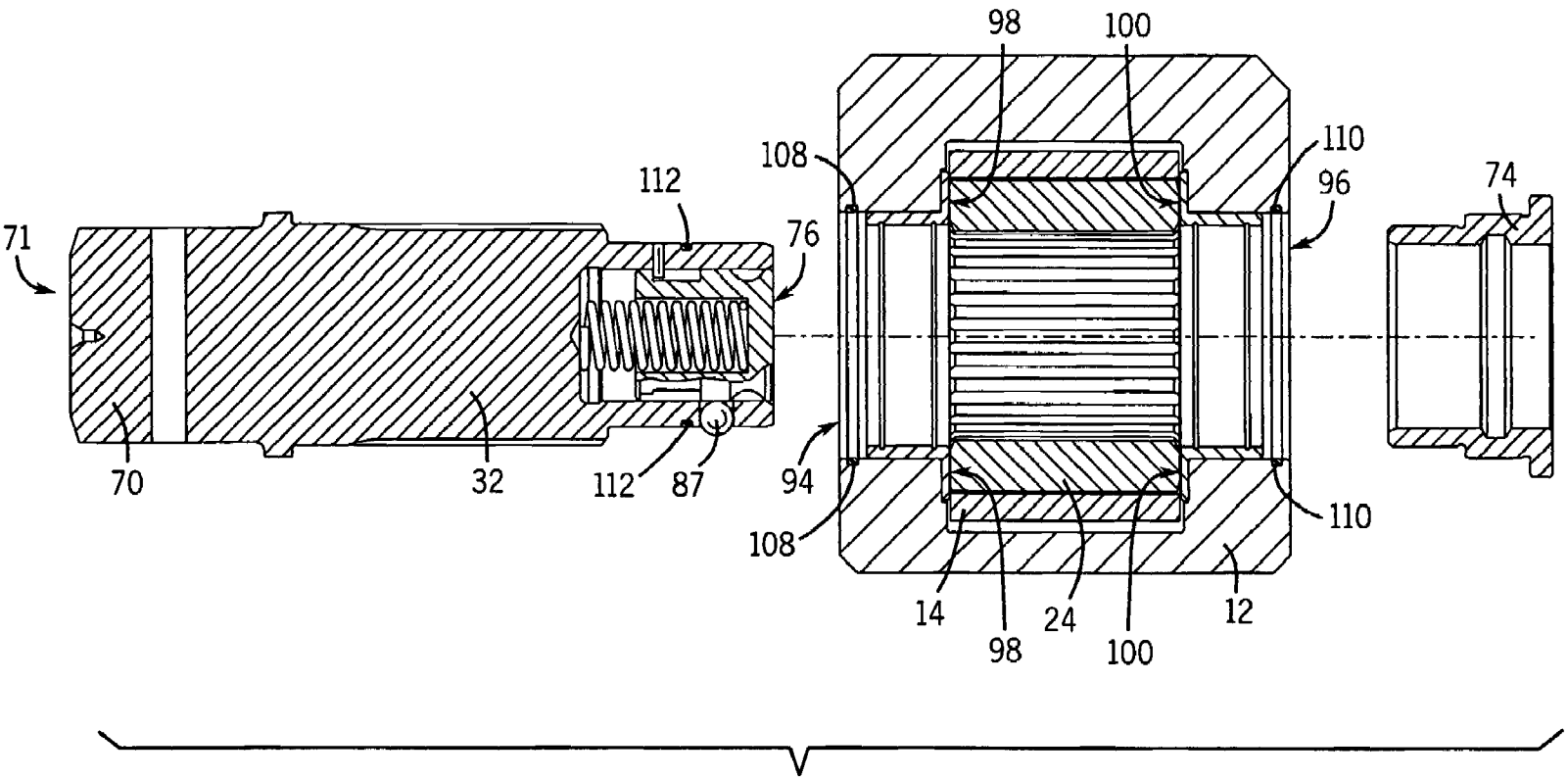
FIG. 9 is a cross-sectional, exploded view of a drive assembly and ratchet housing.
Figure 10:
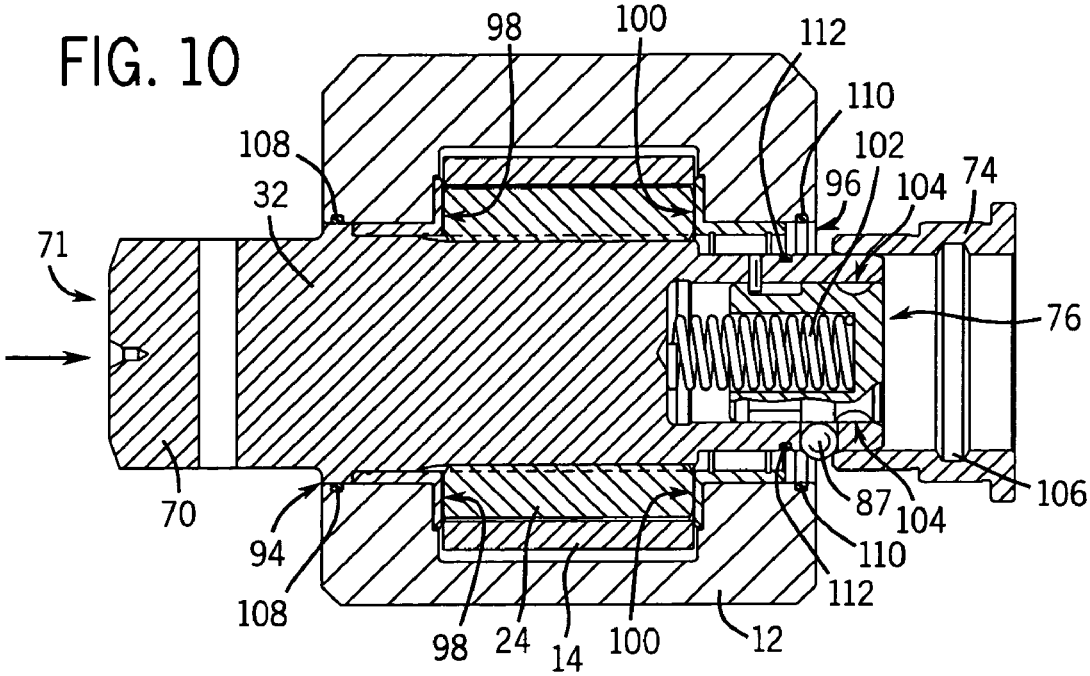
FIG. 10 is a cross-sectional view of the drive assembly and ratchet housing of FIG. 9 in a partially assembled form.
Figure 11:
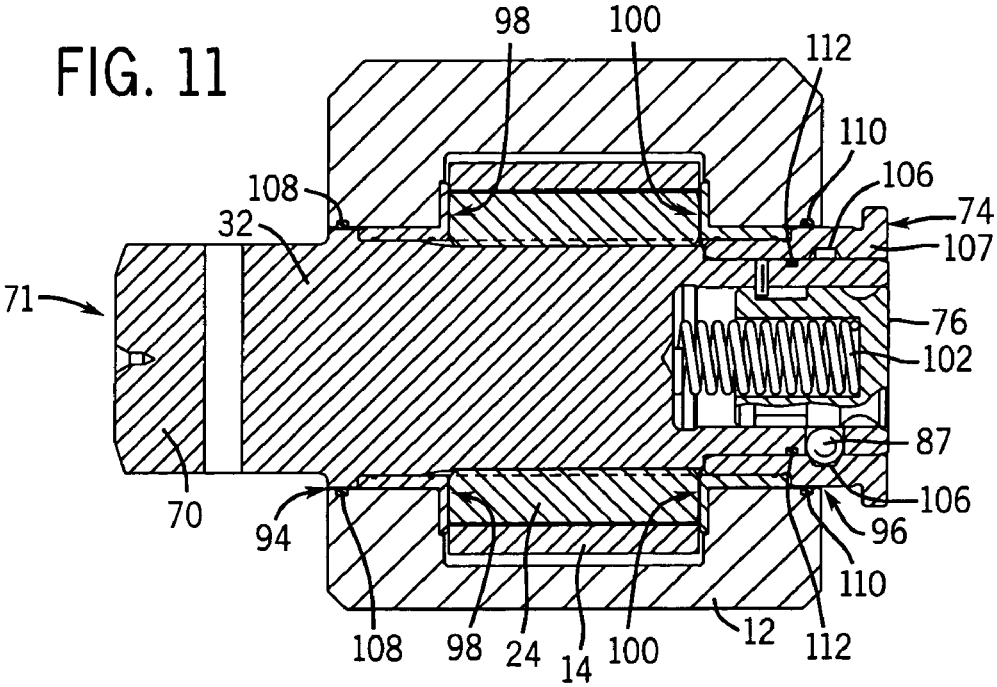
FIG. 11 is a cross-sectional view of the drive assembly and ratchet housing of FIGS. 9 and 10 in a fully assembled form.

As also shown in FIG. 7, the drive 71 includes a set of retractable balls 87 arranged at an end of the drive shaft 32 opposite the socket receptacle 70. Referring now to FIGS. 9–11, the set of retractable balls 87 is used to engage the end cap 74 to retain the drive 71 within the housing 12.

Also shown in FIG. 8, the ratchet lever 14 includes a first cutout 88 arranged to allow the hinge pin 40 of FIG. 1 to pass therethrough. Similarly, the ratchet lever 14 includes a second cutout 90 arranged to allow the screw 42 of FIG. 1 to pass therethrough and to allow a screwdriver (not shown) to tighten the screw 42 into the piston end cap 36 of FIG. 1.

Referring to FIG. 9, the drive 71 and end cap 74 are shown removed from the housing 12. To assemble the components, the drive 71 is passed through a first hole 94 and a second hole 96 in the housing 12. As such, as shown in FIG. 10, the drive 71 is disposed within the housing 12 and extends from both the first opening 94 and second opening 96. The ratchet wheel 24 forms a shaft extending from the first hole 94 to the second hole 96 within which the drive 71 is disposed to mate therewith and be driven by the ratchet wheel as it rotates.

To support the drive 71 within the housing 12, a first set of bearings 98 is arranged on an inner portion of the first opening 94 and a second set of bearings 100 is arranged on an inner portion of the second opening 96. Accordingly, the first set of bearings 98 supports the drive 71 directly and, as will be described, the second set of bearings 100 supports the drive 71 through the end cap 74 to allow the drive 71 to be rotated within the housing 12.

Once the drive 71 is positioned in the housing 12, the end cap 74 is engaged with the drive 71. In particular, the end cap 74 slides over the drive 71 and is stopped by the retractable ball 87. For clarity, only one of the plurality of retractable balls 87 is shown, however, it is contemplated that a plurality of retractable balls are disposed about the drive 71. To lock the end cap 74 on the drive 71, the push button 76 is depressed against a bias spring 102. Accordingly, a ball receptacle 104 formed in the push button 76 is positioned to receive the retractable ball 87 and, thereby, allow the end cap 74 to slide past the retractable ball 87 to the position shown in FIG. 11.

Accordingly, as shown in FIG. 11, the end cap 74 is retained on the drive 71 by sliding the end cap 74 down the drive 71 to align the retractable ball 87 with a ball receptacle 106 within a housing 107 of the end cap 74. As shown, when the push button 76 is released, the biasing spring 102 forces the push button 76 outward to, thereby, force the retractable ball 87 into the ball receptacle 106 within the end cap 74. In this regard, the end cap 74 is engaged with the drive 71 to lock the drive 71 within the housing 12. As shown, the drive 71 is supported through the end cap 74 against the second set of bearings 100.

When the drive 71 is locked within the housing 12 using the end cap 74, a plurality of seals are formed between the housing 12 and the drive shaft 71. Specifically, a first seal is formed at the first opening 94 by a first o-ring 108. As shown in FIG. 11, the first o-ring 108 is positioned on an outer portion of the first opening 94 to create a seal between the drive 71 and the housing 12 to protect the components arranged within the housing 12 from dirt, debris, and liquids. Similarly, a second seal is formed at the second opening 96 by a second o-ring 110. As shown, the second o-ring 110 is positioned on an outer portion of the second opening 96 to create a seal between the end cap 74 and the housing 12. Additionally, a third seal is formed at the second opening 96 by a third o-ring 112 positioned about the drive 71 in a groove formed near the retractable balls 87. Alternatively, the third o-ring may be disposed within the end cap 74. Similarly, the first and second o-rings 108, 110 may be disposed on the drive 71 and on the exterior of the end cap 74, or any combination thereof. In any case, the third o-ring 112 forms a seal between the drive 71 and the end cap 74. Accordingly, the second and third o-rings 110, 112 act in concert to seal the second opening 96 and protect the components arranged within the housing 12 from dirt, debris, and liquids.

Therefore, although the drive shaft 71 is removable from the housing 12 and rotatable within the housing 12, the seals 108, 110, 112 preclude the entry of dirt, debris, and liquid into the housing 12. Accordingly, the torque wrench is readily adapted for use in harsh environments, for example, in or around salt water or other corrosive or semi-corrosive elements, because the internal components of the wrench are sealed and protected from the invasion of elements from the environment. As such, the life of the torque wrench is extended, even when operated in harsh environments.

Figure 12:
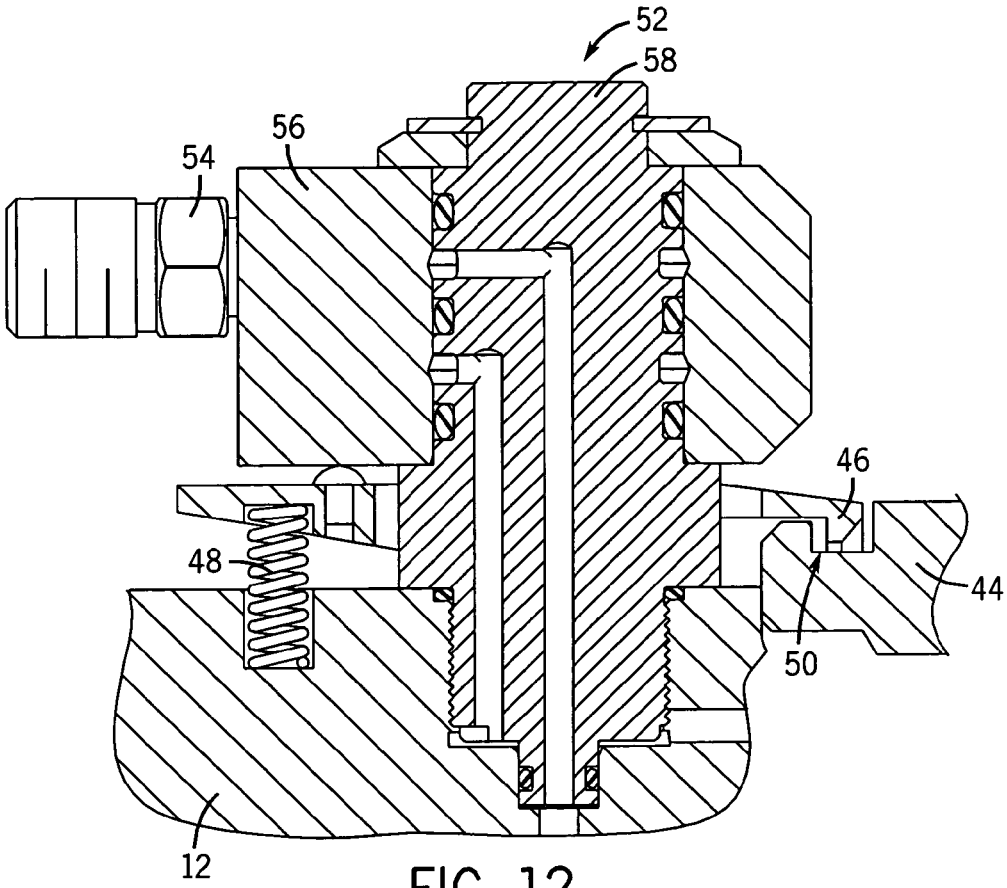
FIG. 12 is a detailed cross-sectional view of a hydraulic fluid port and quick connect coupler of FIG. 1.
Figure 13:
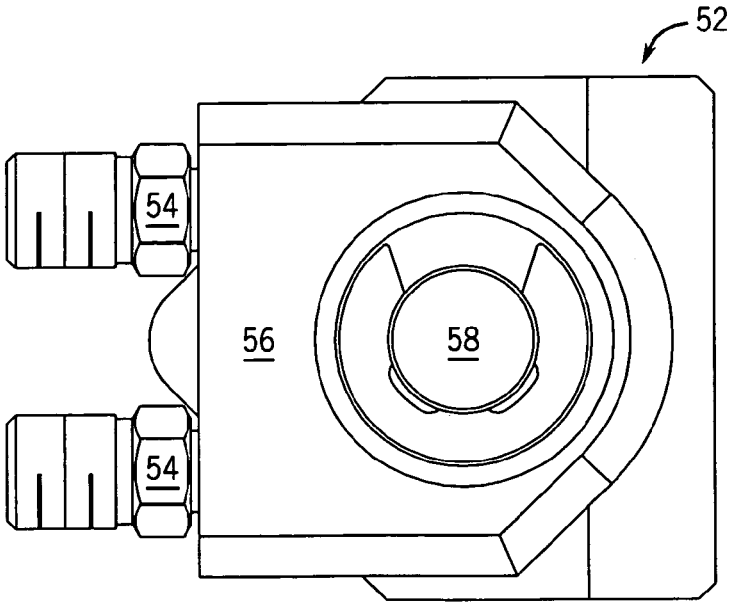
FIG. 13 is a plan view of the hydraulic fluid ports of FIG. 12.

Referring now to FIGS. 12 and 13, the quick latch 46 and the hydraulic fluid port 52 are shown in additional detail. Specifically, the hydraulic fluid port 52 includes two quick couplers 54 connected through a swivel connection block 56 to a swivel connection bolt 58 that, together, provide a means to supply and extract hydraulic fluid through the housing 12. Arranged about the hydraulic fluid port 52 is the quick latch 46. The quick latch 46 is biased by the spring 48 to engage the lip 50 formed in the reaction arm 44.

Therefore, the above-described torque wrench 10 provides a system that is readily adapted for use in a wide variety of environments without exposing the internal components of the torque wrench 10 the elements of such environments. That is, the torque wrench 10 includes a plurality of seals preferably formed by a plurality of o-rings 62, 108, 110, 112 or other suitable sealing form that creates protective barriers against dirt, debris, and liquids. In particular, the wrench includes an o-ring 62 arranged about a cover 64 closing the opening 60 into the cavity within the housing 12 of the wrench 12. As such, the components of the wrench, such as the ratchet lever 14 and the hydraulically actuated piston 16, are protected from the intrusion of elements from the working environment of the torque wrench 10 through the opening 60. Additionally, the torque wrench 10 includes a system of o-rings 108, 110, 112 designed to seal the torque wrench 10 against the intrusion of dirt, debris, and liquids that would otherwise be introduced due to the removable drive 71. In this regard, these seals allow the wrench 10 to be utilized in a wide variety of environments without diminishing the life of the torque wrench 10.

In one aspect, a coupling exists between the piston and the ratchet lever that enables a high rotation angle for each stroke of the piston to result in increased productivity and a reliable non-jamming mechanism. In addition, this mechanism provides high repeatability that can result in a slim nose radius to fit into small spaces and with few moving parts to result in improved durability and low maintenance.

In another aspect, the drive, which may be a square drive, an Allen key drive or a different type of drive, is of a highly reliable construction, which is also easy to maintain. The drive can be released from its bearings by a push button, making maintenance and adjustments very easy. In addition, the above-described construction permits bearings to be positioned at both sides of the wrench for excellent durability and support of the drive shaft. In another aspect, hydraulic connections can be made to the torque wrench through a swivel coupler. Such connections can be made for a double acting piston that is part of the torque wrench, to drive the piston back and forth.

In another aspect, a cover closes an opening to the cavity in which the ratchet lever mechanisms of the wrench are housed and sealed against the intrusion of dirt, debris, and liquids. Additionally a plurality of seals are formed about the removable drive to protect against the intrusion of dirt, debris, and liquids. Accordingly, the life of the torque wrench is extended even when operated in harsh working environments.

Therefore, one embodiment of the present invention includes a torque wrench having a housing with a first opening disposed opposite a second opening. The torque wrench also includes a ratchet wheel disposed in the housing and forming a shaft connecting the first opening and the second opening, a ratchet lever engaging the ratchet wheel to rotate the ratchet wheel in a given direction, and a hydraulically actuated piston disposed in the housing and connected to the ratchet lever to move the ratchet lever between a first position and a second position to rotate the ratchet wheel. The torque wrench further includes a removable drive shaft extending through the shaft to engage the ratchet wheel and be rotated by the ratchet wheel in the given direction and a first seal disposed at the first opening and a second seal disposed at the second opening to create respective seals between the housing and the drive shaft.

According to another embodiment of the invention, a torque wrench includes a ratchet wheel, a ratchet lever engaging the ratchet wheel to rotate the ratchet wheel in a given direction, and a hydraulically actuated piston connected to the ratchet lever to move the ratchet lever between a first position and a second position to rotate the ratchet wheel. The torque wrench also includes a drive shaft extending through the shaft to engage the ratchet wheel and be rotated by the ratchet wheel in the given direction and a housing having an access portal formed therein to allow the ratchet wheel, the ratchet lever, and the hydraulically actuated piston to be disposed within the housing. Additionally, the torque wrench includes a cover configured to removeably engage the housing to cover the access portal and at least one seal disposed between the cover and the housing to seal the access portal.

The present invention has been described in terms of the preferred embodiment, and it should be appreciated that many equivalents, alternatives, variations, and modifications, aside from those expressly stated, are possible and within the scope of the invention. Therefore, the invention should not be limited to a particular described embodiment.

We claim:

1. A torque wrench comprising:

a housing having a first opening disposed opposite a second opening;

a ratchet wheel disposed in the housing and forming a shaft connecting the first opening and the second opening;

a ratchet lever engaging the ratchet wheel to rotate the ratchet wheel in a given direction;

a hydraulically actuated piston disposed in the housing and connected to the ratchet lever to move the ratchet lever between a first position and a second position to rotate the ratchet wheel;

a removable drive shaft extending through the shaft to engage the ratchet wheel and be rotated by the ratchet wheel in the given direction; and a first seal disposed at the first opening and a second seal disposed at the second opening to create respective seals between the housing and the drive shaft.

2. The torque wrench of claim 1 wherein the first seal and the second seal are o-rings disposed in respective grooves positioned in the first opening and the second opening.

3. The torque wrench of claim 2 further comprising a stud disposed at a first end of the drive shaft to engage a socket and an end cap removeably engaged with a second end of the drive shaft to lock the drive shaft within the shaft and wherein the first seal engages a rounded lip from which the socket extends and the second seal engages a rounded lip of the end cap.

4. The torque wrench of claim 3 wherein the rounded lip of the drive shaft and the rounded lip of the end cap are substantially similar such that the drive shaft may be removed and extended through the shaft to engage the first seal with the lip of the end cap and the second seal with the lip of the drive shaft.

5. The torque wrench of claim 4 wherein the drive shaft can enter the shaft through the first opening to rotate the socket in a first relative direction as the drive shaft rotates in the given direction and enter the shaft through the second opening to rotate the socket in a second relative direction as the drive shaft rotates in the given direction.

6. The torque wrench of claim 1 further comprising an end cap removeably engaging an end the drive shaft to lock the drive shaft within the shaft.

7. The torque wrench of claim 6 further comprising a seal disposed between the end cap and the end of the drive shaft.

8. The torque wrench of claim 6 further comprising at least one of an Allen key drive and a push button lock configured to release the end cap from the end of the drive shaft.

9. The torque wrench of claim 1 further comprising a first bearing disposed about an inner portion of the first opening and a second bearing disposed about an inner portion of the second opening and wherein the drive shaft is supported by the first bearing and the second bearing when extending through the shaft.

10. The torque wrench of claim 9 wherein the first seal is disposed between an outer portion of the first opening and the drive shaft and the second seal is disposed between an outer portion of the first opening and the drive shaft.

11. The torque wrench of claim 1 wherein the hydraulically actuated piston is connected to the ratchet lever through a pin rotatably engaged with the ratchet lever to allow the ratchet lever to pivot between the first position and the second position to rotate the ratchet wheel.

12. The torque wrench of claim 1 further comprising a pair of swivel mounted quick couplers configured to receive hydraulic fluid from a hydraulic fluid supply.

13. The torque wrench of claim 1 further comprising an portal disposed in the housing to allow the ratchet wheel, the ratchet lever, and the hydraulically actuated piston to be disposed within the housing.

14. The torque wrench of claim 13 further comprising a cover disposed over the portal.

15. The torque wrench of claim 14 further comprising a seal disposed between the cover and the housing to restrict entry into the portal.

16. The torque wrench of claim 1 further comprising a reaction arm removeably engaged to the housing through a common spline.

17. The torque wrench of claim 1 further comprising a pawl disposed in the ratchet lever and biased through a spring against the ratchet wheel to engage a plurality of teeth disposed about the ratchet wheel to rotate the ratchet wheel in the given direction as the ratchet lever moves between the first position and the second position.

18. The torque wrench of claim 1 further comprising at least one stud extending from at least one end of the drive shaft to receive a socket thereon.

19. The torque wrench of claim 1 wherein the housing is formed from a corrosion resistant material.

20. A torque wrench comprising:

a ratchet wheel;

a ratchet lever engaging the ratchet wheel to rotate the ratchet wheel in a given direction;

a hydraulically actuated piston connected to the ratchet lever to move the ratchet lever between a first position and a second position to rotate the ratchet wheel;

a drive shaft extending through the shaft to engage the ratchet wheel and be rotated by the ratchet wheel in the given direction;

a housing having an access portal formed therein to allow the ratchet wheel, the ratchet lever, and the hydraulically actuated piston to be disposed within the housing;

a cover configured to removeably engage the housing to cover the access portal; and at least one seal disposed between the cover and the housing to seal the access portal.

* * * * *